US012704022B2

(12) United States Patent
Schultz et al.

(10) Patent No.: US 12,704,022 B2
(45) Date of Patent: Aug. 11, 2026

(54) DOWNHOLE FLUID MOTOR AND ASSOCIATED METHODS

(71) Applicant: THRU TUBING SOLUTIONS, INC., Newcastle, OK (US)

(72) Inventors: Roger L. Schultz, Ninnekah, OK (US); Trevor M. Brasselle, Lawrenceville, GA (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/817,784

(22) Filed: Aug. 28, 2024

(65) Prior Publication Data

US 2026/0062999 A1 Mar. 5, 2026

(51) Int. Cl.
*E21B 4/02* (2006.01)
*F01C 1/10* (2006.01)

(52) U.S. Cl.
CPC ..... *E21B 4/02* (2013.01); *F01C 1/101* (2013.01)

(58) Field of Classification Search
CPC ..... F01C 1/101
See application file for complete search history.

(56) References Cited

U.S. PATENT DOCUMENTS 1,703,037 A * 2/1929 Heck ..... F16L 13/04 228/136
3,912,426 A * 10/1975 Tschirky ..... F01C 1/101 418/48
4,207,037 A 6/1980 Riordan
4,324,299 A 4/1982 Nagel
4,523,872 A * 6/1985 Arena ..... F16D 1/072 403/292
4,909,337 A * 3/1990 Kochnev ..... E21B 4/02 175/323
5,145,342 A * 9/1992 Gruber ..... F04C 2/1075 418/153
5,832,604 A 11/1998 Johnson et al.
6,293,358 B1 * 9/2001 Jager ..... E21B 4/02 418/48
6,358,027 B1 3/2002 Lane
7,396,220 B2 * 7/2008 Delpassand ..... F04C 13/008 418/153
10,145,420 B2 * 12/2018 Kawahara ..... B21D 39/048
10,920,493 B2 * 2/2021 Huber ..... E21B 4/02
(Continued)

OTHER PUBLICATIONS

Office Action issued Jan. 12, 2026 for U.S. Appl. No. 18/935,723, 23 pages.

(Continued)

*Primary Examiner* — Jacob J Cigna
(74) *Attorney, Agent, or Firm* — Smith IP Services, P.C.

(57) ABSTRACT

A downhole fluid motor can include a tubular housing and multiple stator sections. Each of the stator sections has a helical stator profile formed therein. Deformation of the housing secures each respective stator section in the housing. A method of producing a downhole fluid motor can include securing multiple stator sections to each other, each of the stator sections having a stator profile formed therein, and securing the stator sections in a tubular housing. The securing steps can be performed without any welding. The step of the securing the stator sections in the housing can include deforming the housing toward the stator sections.

18 Claims, 12 Drawing Sheets

(56) References Cited

U.S. PATENT DOCUMENTS

| | | | | |
|---|---|---|---|---|
| 11,148,327 | B2 * | 10/2021 | Brand | F04C 13/008 |
| 11,261,666 | B2 * | 3/2022 | Hohl | E21B 4/02 |
| 11,421,693 | B2 * | 8/2022 | Coghlan | F04D 7/045 |
| 11,655,815 | B2 * | 5/2023 | Brasselle | F01C 21/104 418/48 |
| 2009/0169364 | A1 | 7/2009 | Downton | |
| 2015/0078943 | A1 | 3/2015 | Gunter et al. | |

OTHER PUBLICATIONS

Office Action issued Apr. 14, 2026 for U.S. Appl. No. 19/313,527, 14 pages.

Drilling Manual, "Mud Motor In Drilling: Components & Operations," online article, dated Oct. 31, 2017, 26 pages.

* cited by examiner

DOWNHOLE FLUID MOTOR AND ASSOCIATED METHODS

BACKGROUND

This disclosure relates generally to equipment utilized and operations performed in conjunction with a subterranean well and, in an example described below, more particularly provides a downhole fluid motor with a multi-section stator.

Fluid motors can be used for a variety of different purposes. In well operations, a fluid motor is commonly connected as part of a drill string deployed into the well. Fluid flow through the drill string produces rotation of a drill bit connected to the fluid motor.

It will, therefore, be readily appreciated that advancements are continually needed in the art of designing, constructing and utilizing downhole fluid motors. The present disclosure provides such advancements to the art, which may be used with a wide variety of different well operations.

DETAILED DESCRIPTION

Figure 1:
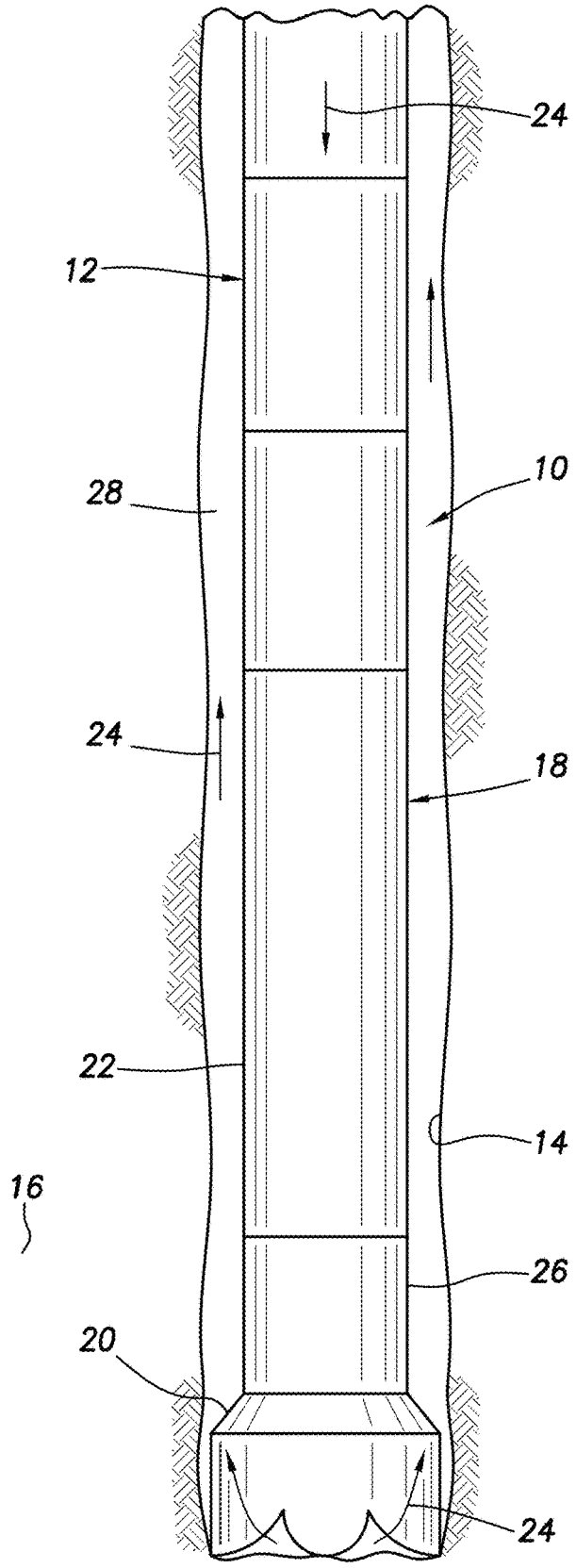
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is being used to drill a wellbore 14 into an earth formation 16. For this purpose, a bottom hole assembly 18 including a drill bit 20 is connected at a distal end of the tubular string 12.

To rotate the drill bit 20, the bottom hole assembly 18 includes a downhole fluid motor 22 (such as, a Moineau-type positive displacement motor). The fluid motor 22 is driven by fluid flow 24 through the tubular string 12. In the FIG. 1 example, the fluid flow 24 passes through the tubular string 12, including the fluid motor 22. The fluid flow 24 produces rotation of a rotor in the fluid motor 22. This rotation is transmitted via a bearing assembly 26 to the drill bit 20.

The fluid flow 24 exits the tubular string 12 via nozzles in the drill bit 20. The fluid flow 24 returns to the surface via an annulus 28 formed radially between the tubular string 12 and the wellbore 14.

In other examples, the fluid motor 22 may be used in well operations other than a drilling operation. For example, the fluid motor 22 could be used in a milling, reaming, completion, abandonment or other type of well operation. Thus, the scope of this disclosure is not limited to any particular details of the FIG. 1 system and method.

Figure 2:
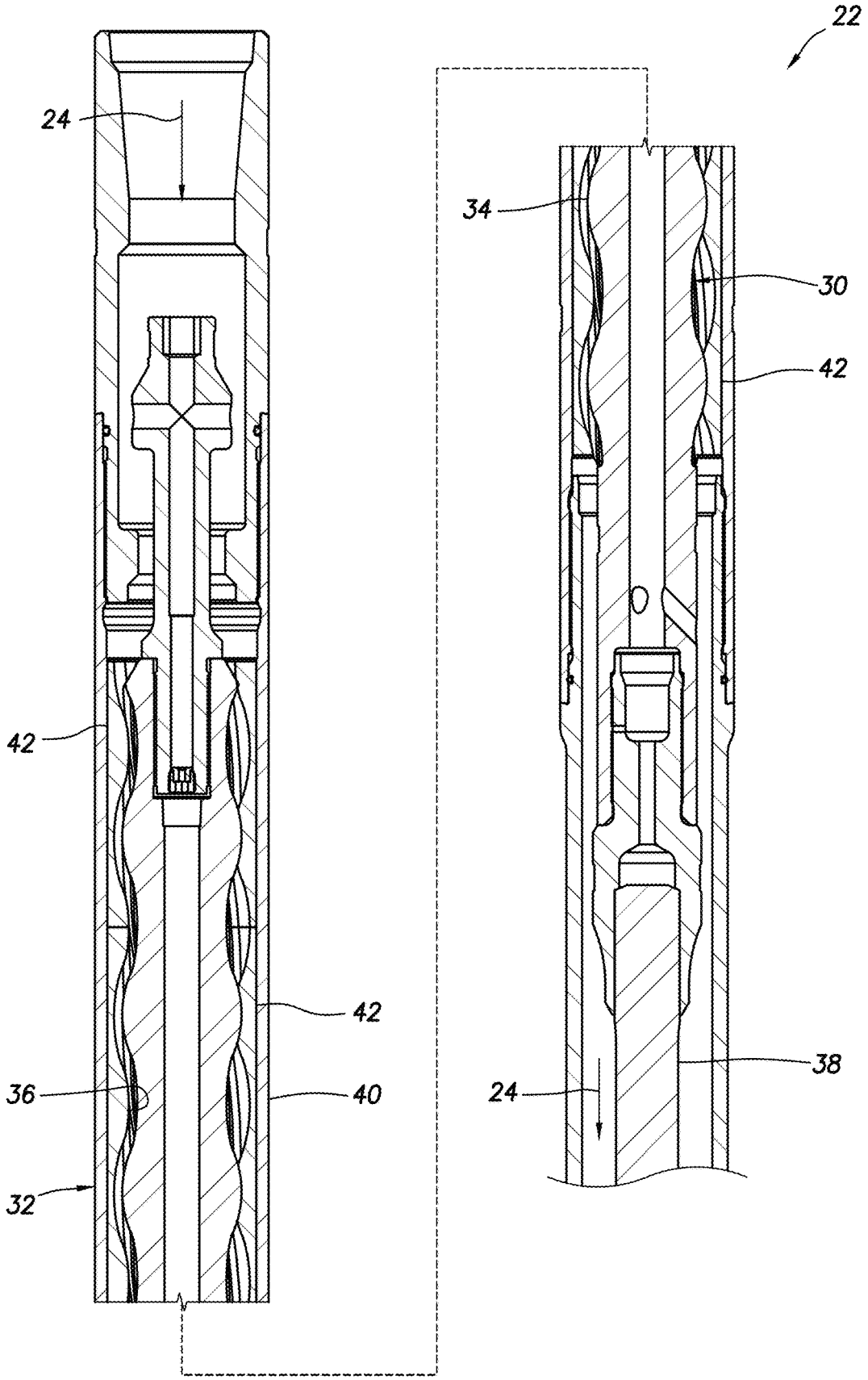
FIG. 2 is a representative cross-sectional view of an example of a downhole fluid motor that may be used in the FIG. 1 system and method.

Referring additionally now to FIG. 2, a cross-sectional view of an example of the fluid motor 22 is representatively illustrated. For convenience, the FIG. 2 fluid motor 22 is described below as it may be used in the FIG. 1 system and method. However, the FIG. 2 fluid motor 22 may be used with other systems and methods.

In the FIG. 2 example, the fluid motor 22 includes a rotor 30 received in a stator 32. The rotor 30 has multiple external helical lobes 34 formed thereon which engage a stator profile comprising multiple internal helical lobes 36 formed in the stator 32. The numbers of external and internal lobes 34, 36 are not the same, so that a cavity formed between the external and internal lobes progresses axially between the rotor 30 and stator 32 as the rotor rotates in the stator.

The fluid flow 24 between the rotor 30 and the stator 32 produces rotation of the rotor. This rotation is transmitted via a flexible drive shaft 38 and the bearing assembly 26 (see FIG. 1) to the drill bit 20.

The stator 32 includes an outer housing 40. The internal lobes 36 are formed in axially stacked stator sections 42 received in the housing 40. The stator sections 42 can be rotationally indexed relative to each other (so that the lobes 36 extend continuously in series through the stator sections) and secured in the housing 40 in a variety of different ways, examples of which are described more fully below.

Figure 3:
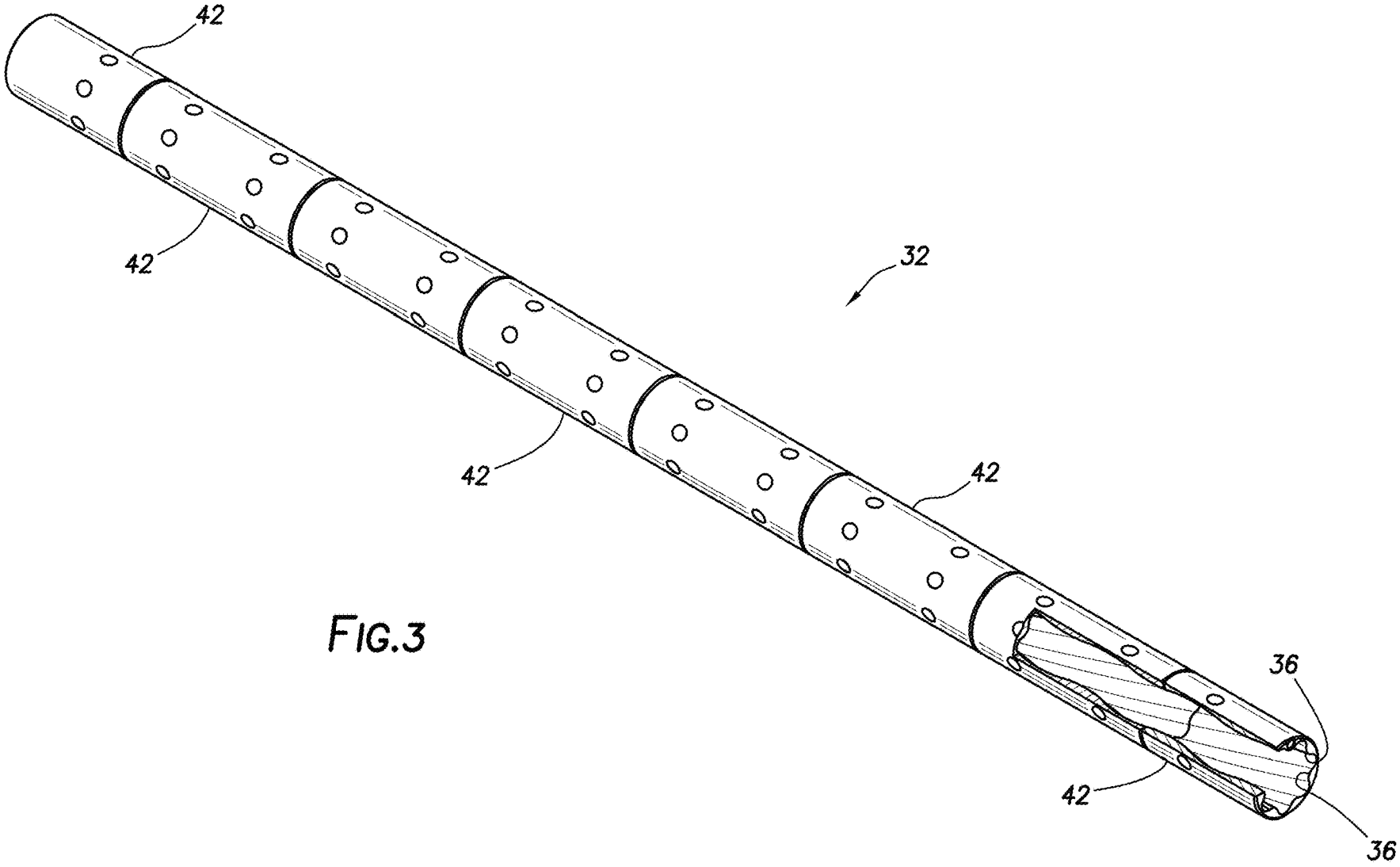
FIG. 3 is a representative partially cross-sectional perspective view of an example of an assembly of stator sections that may be used in the FIG. 2 fluid motor.

Referring additionally now to FIG. 3, a partially cross-sectional view of an example of the axially stacked stator sections 42 is representatively illustrated. The FIG. 3 stator sections 42 may be used in the FIG. 2 fluid motor 22, or they may be used in other fluid motors. For convenience, the FIG. 3 stator sections 42 are described below as they may be used in the FIG. 2 fluid motor 22.

As depicted in FIG. 3, there are eight of the stator sections 42 in the stator 32. At opposite ends of the stack, the stator sections 42 are not as long as the six stator sections between the ends. In other examples, all of the stator sections 42 may have the same length, or the stator sections may all have different lengths. The scope of this disclosure is not limited to any particular number, lengths, combination of lengths or arrangement of the stator sections 42.

Figure 4:
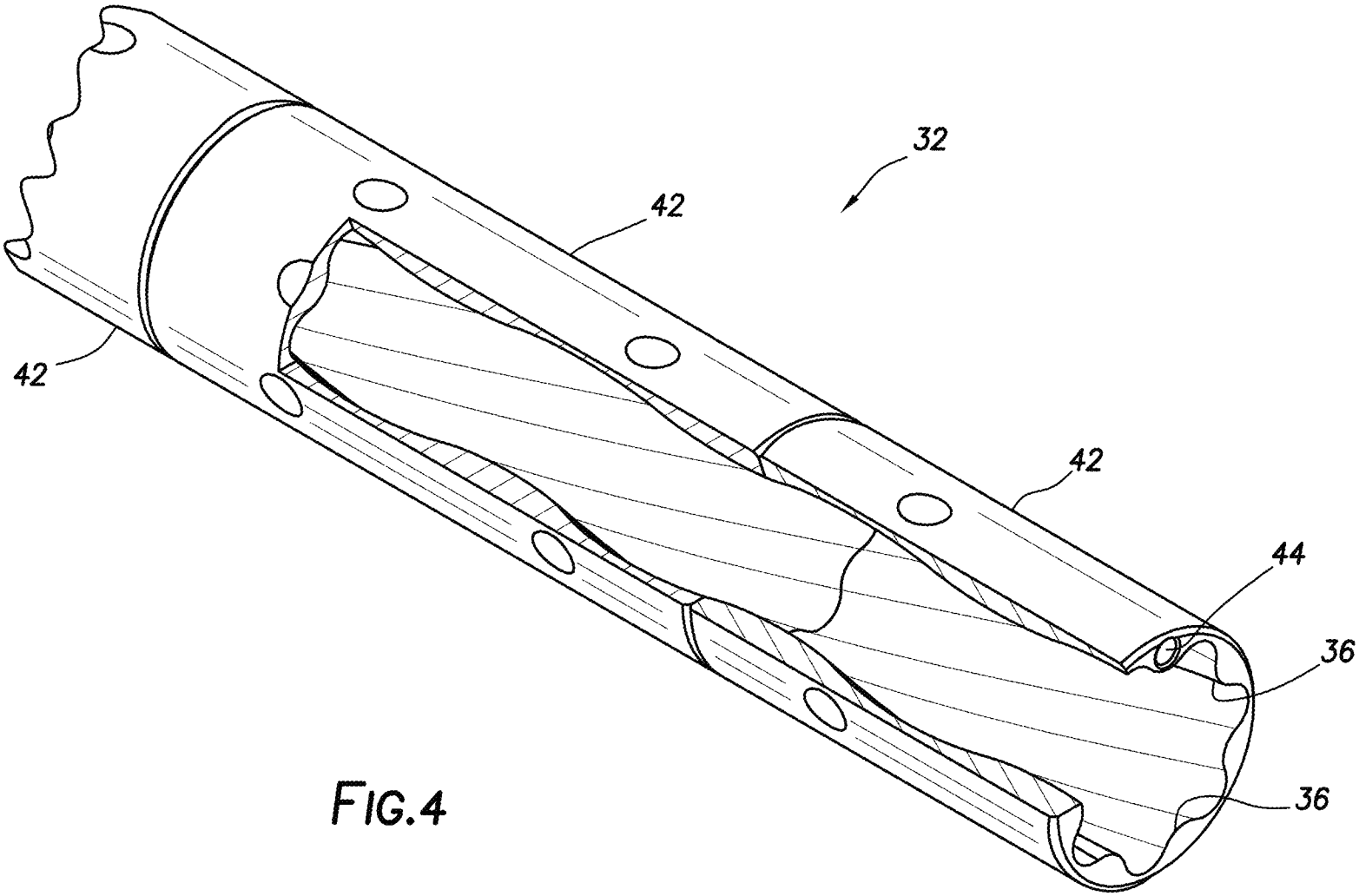
FIG. 4 is a representative partially cross-sectional perspective view of an end of the FIG. 3 assembly of stator sections.

Referring additionally now to FIG. 4, an enlarged view of one end of the stack of stator sections 42 is representatively illustrated. In this view, the manner in which the stator sections 42 are rotationally indexed relative to each other can be more clearly seen. The internal helical lobes 36 are rotationally aligned between adjacent pairs of the stator sections 42, so that the lobes extend continuously through the stack of stator sections.

An opening 44 can extend helically through a lobe 36 of each stator section 42. The openings 44 of adjacent pairs of the stator sections 42 can be rotationally aligned (e.g., due to the rotational indexing of the stator sections), so that the opening extends continuously through the stack of stator sections. The opening 44 may be used as a conduit for conductors, optical fibers, fluid flow or pressure, etc., in the fluid motor 22.

Figure 5:
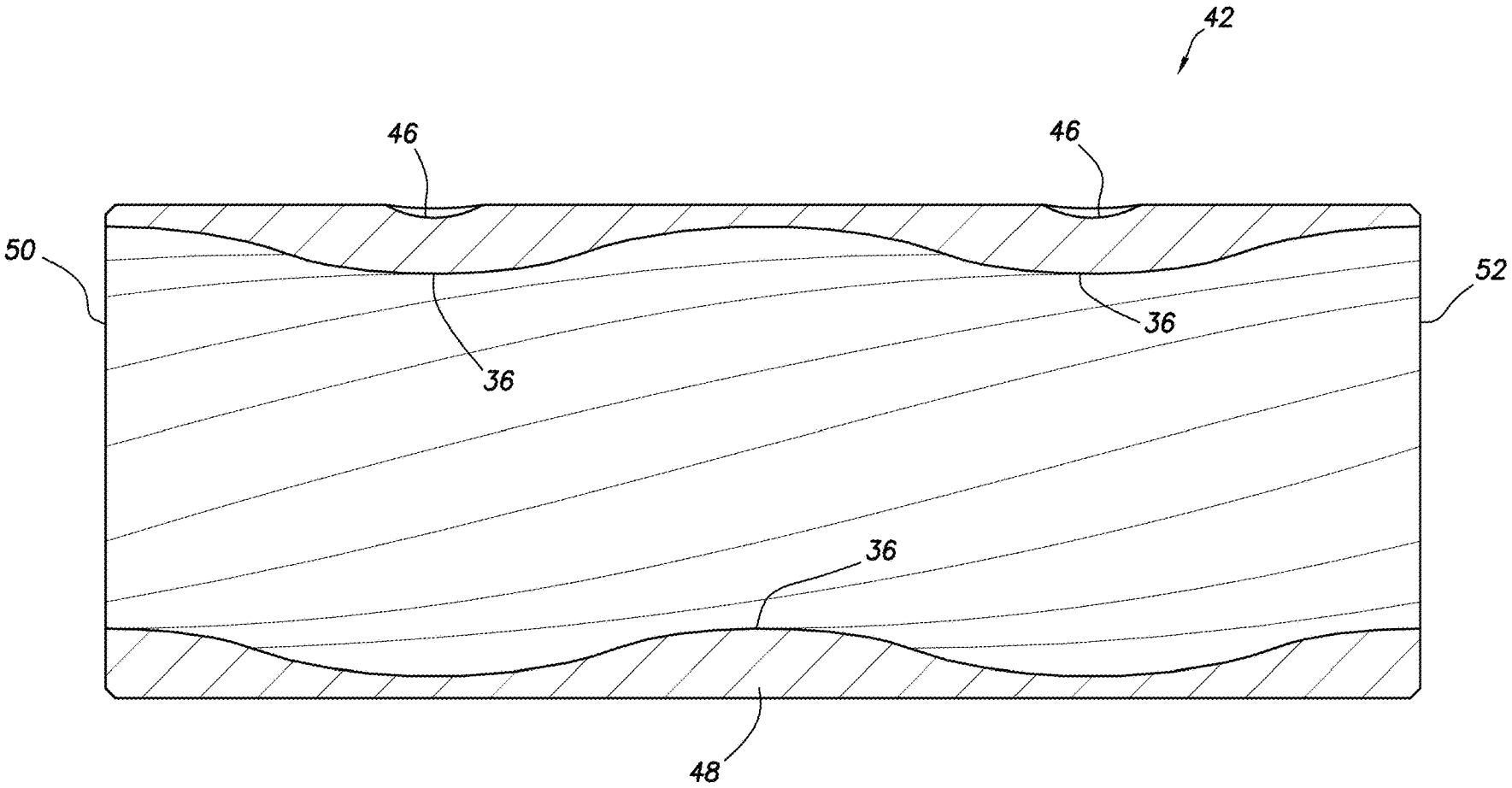
FIG. 5 is a representative cross-sectional view of an example of a stator section.

Referring additionally now to FIG. 5, a cross-sectional view of an example of the stator section 42 is representatively illustrated. The FIG. 5 stator section 42 may be used in the FIG. 2 fluid motor, or it may be used with other fluid motors.

In the FIG. 5 example, recesses 46 are formed in an outer surface of the stator section 42. As described more fully below, the recesses 46 can receive protrusions formed in the housing 40, to thereby secure the stator section 42 in the housing and to maintain the rotational indexing between adjacent pairs of stator sections.

As depicted in FIG. 5, the recesses 46 are aligned with the lobes 36, so that the recesses are positioned in relatively thicker portions of the stator section 42. In other examples, the recesses 46 are not necessarily aligned with the lobes 36, the recesses may be used for other purposes, or the recesses may not be formed on the stator section. Any number or arrangement of the recesses 46 may be used.

The stator section 42 is preferably made of a material 48 that is relatively hard and non-elastomeric. Suitable materials include (but are not limited to) metals, cross-linked polymers, etc. The material 48 may be cast, forged, sintered, molded, or produced by electrical discharge machining (EDM), conventional machining, powder metallurgy, or any other suitable technique.

If the rotor 30 and the stator sections 42 are each made of a metal material, then there may be metal-to-metal contact between the internal lobes 36 of the stator sections and the external lobes 34 of the rotor. This metal-to-metal contact can have the benefit of extended useful life of the fluid motor 22. For enhanced sealing between the rotor 30 and the stator sections 42, a lining may be provided on interior surfaces of the lobes 36, as described more fully below.

To achieve and maintain rotational indexing of the stator section 42 with adjacent stator sections, opposite ends 50, 52 of the stator section 42 can have profiles, recesses, protrusions, fasteners or other types of engagement devices. These alignment or engagement devices may be formed on, attached or connected to the stator section 42. In one example, helical grooves could be formed on exterior surfaces of the stator sections 42 (such as, aligned with one of the lobes 36), and a helical member could be installed in the aligned grooves to maintain the rotational alignment of the stator sections.

Figure 6:
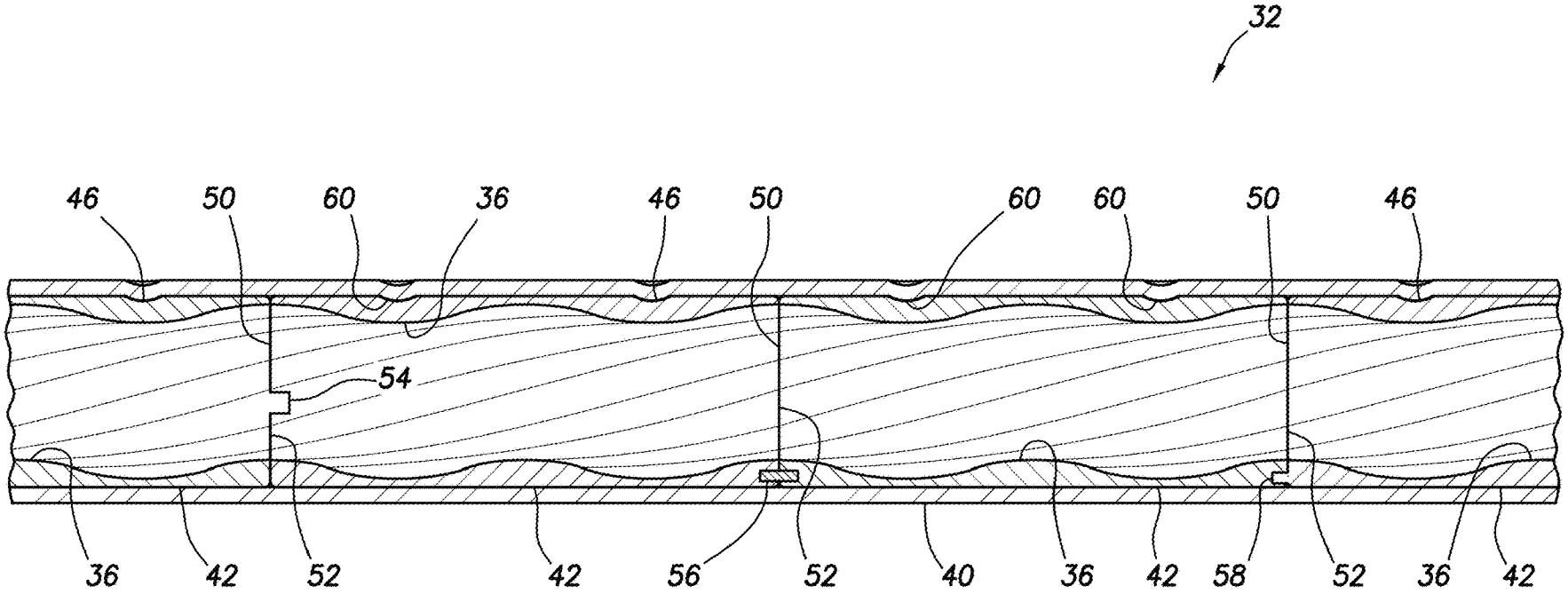
FIG. 6 is a representative cross-sectional view of an example of a stator.

Referring additionally now to FIG. 6, a cross-sectional view of an example of a portion of the stator 32 is representatively illustrated. In the FIG. 6 example, a stack of the stator sections 42 has been installed in the housing 40. Various examples of engagement devices are depicted in FIG. 6 for rotational indexing of the stator sections 42.

In a first device 54, adjacent stator sections 42 are rotationally interlocked by engagement of a tab formed on an end 52 of one of the stator sections with a slot formed on a facing end 50 of the other stator section. In a second device 56, a fastener or pin is received in openings formed in the facing ends 50, 52 of adjacent stator sections 42. In a third device 58, a profile (e.g., in the shape of a protrusion) on one end 50 is engaged with a complementary profile (e.g., in the shape of a recess) on the opposing end 52. However, the devices 54, 56, 58 are merely examples of possible engagement devices, and other types of rotational indexing or rotational alignment devices may be used in other examples.

As depicted in FIG. 6, the stator sections 42 are secured in the housing 40 with protrusions 60 formed on an interior surface of the housing. The protrusions 60 extend into engagement with respective ones of the recesses 46 on the stator sections 42. This engagement prevents relative displacement between the housing 40 and the stator sections 42 in axial and rotational directions. Thus, in examples in which the protrusions 60 are engaged with the recesses 46, this engagement can maintain rotational indexing and alignment between the stator sections 42, so that the engagement devices 54, 56, 58 (or any other rotational indexing or alignment devices) may not be used.

Note that mechanical interference could be provided between the stator sections 42 and the housing 40 in a variety of different ways. For example, use of the recesses 46 is not necessary, since the housing 40 could be deformed into contact with the stator sections 42 to thereby secure the stator sections in the housing. The stator sections 42 could be press-fit or shrink-fit in the housing 40. A helical groove could be formed in the housing 40 for engagement with a helical profile formed on each of the stator sections 42 in another example.

Figure 7:
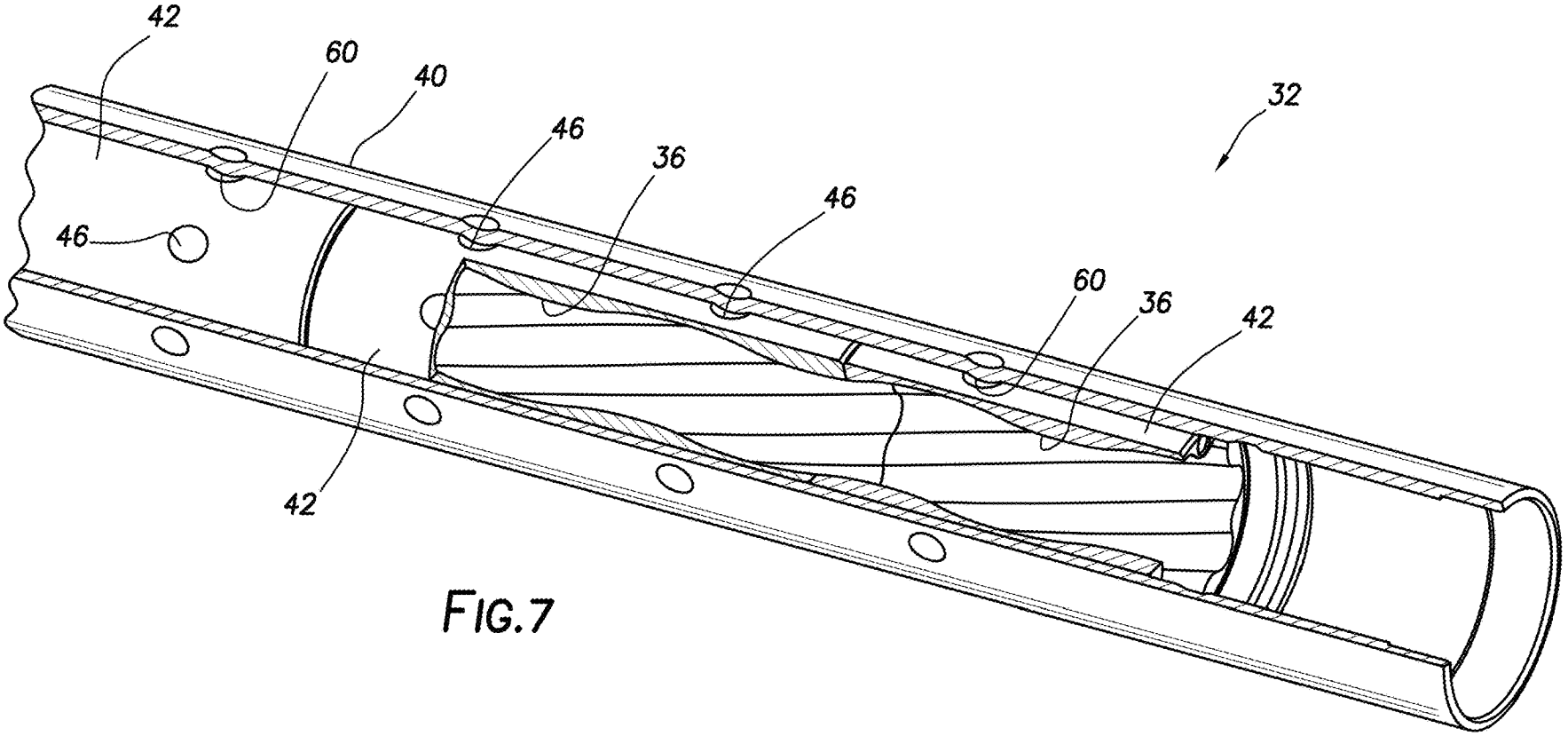
FIG. 7 is a representative partially cross-sectional perspective view of an end of the stator.

Referring additionally now to FIG. 7, a partially cross-sectional view of another example of the stator 32 is representatively illustrated. In this example, the stator sections 42 are secured in the housing 40 using the protrusions 60 engaged with the recesses 46 on the stator sections. The engagement between the protrusions 60 and the recesses 46 also rotationally indexes and aligns the stator sections 42 relative to each other, and no additional engagement devices are used.

Figure 8:
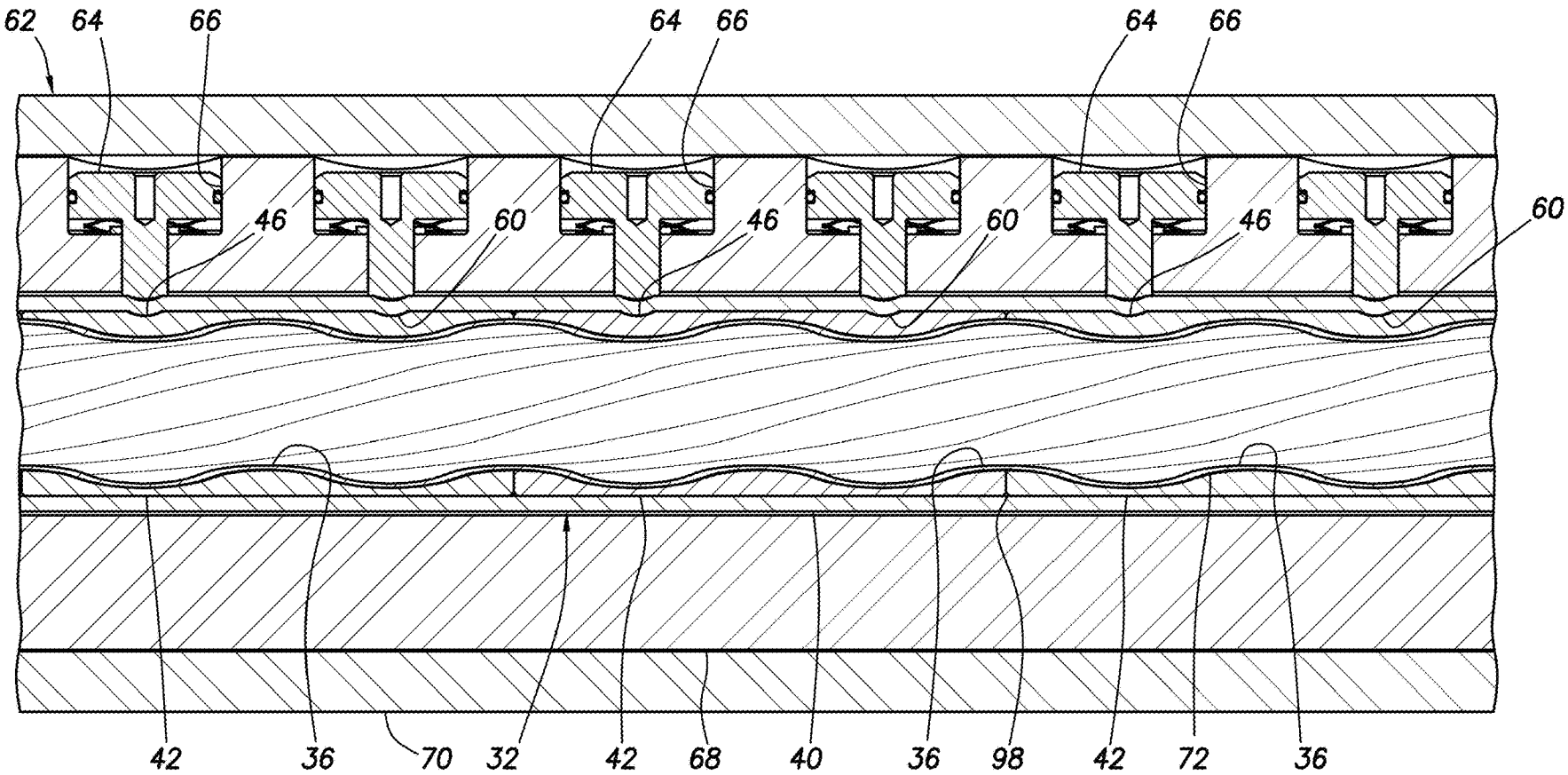
FIG. 8 is a representative cross-sectional view of an example of a housing deformation tool for use with the stator.

Referring additionally now to FIG. 8, a cross-sectional view of an example of the protrusions 60 being formed in the housing 40 of the stator 32 is representatively illustrated. In this example, the housing 40 with the stack of stator sections 42 therein is inserted into a housing deformation tool 62. The housing 40 is deformed by the tool 62, so that the protrusions 60 are formed on the interior surface of the housing, and the protrusions extend into respective ones of the recesses 46.

The stator sections 42 are rotationally indexed and aligned with each other prior to the housing 40 being deformed. After deformation of the housing 40, the rotational indexing and alignment is maintained by the engagement between the protrusions 60 and the recesses 46.

In the FIG. 8 example, the tool 62 includes multiple pistons 64 received in bores 66 formed in an inner body 68. Pressure applied between the inner body 68 and an outer housing 70 biases the pistons 64 to displace inward toward the housing 40. Sufficient applied pressure will cause the housing 40 to deform inward toward the stator sections 42, so that the protrusions 60 are formed and engage the recesses 46.

The stator sections 42 may be rotationally indexed and aligned with each other before or after they are installed in the housing 40, and before or after they are received in the tool 62. In other examples, other means may be used for rotationally indexing or aligning the stator sections 42, or for securing the stator sections in the housing 40.

For example, the stator sections 42 could be rotationally indexed and aligned with each other (such as, using the engagement devices 54, 56, 58, or using an alignment mandrel inserted into the stator sections), and then the adjacent stator sections could be welded to each other. In another example, the stator sections 42 could be rotationally indexed and aligned with each other, and then the stator sections could be secured to the housing 40 by welding through holes formed through a wall of the housing. In yet another example, a material 98 (such as, an elastomer, a cement, a polymer, a bonding agent, etc.) could be injected between the housing 40 and the stator sections 42 after the stator sections are rotationally indexed and aligned with each other. When the material cures, the stator sections 42 are thereby secured in the housing 40 and are rotationally indexed and aligned with each other. Thus, the scope of this disclosure is not limited to any particular technique for rotationally indexing and aligning the stator sections 42, or to any particular order of steps (e.g., indexing and aligning the stator sections, installing the stator sections in the housing 40, securing the stator sections to each other and to the housing, etc.), or to any particular technique for securing the stator sections to each other or in the housing 40.

Figure 9:
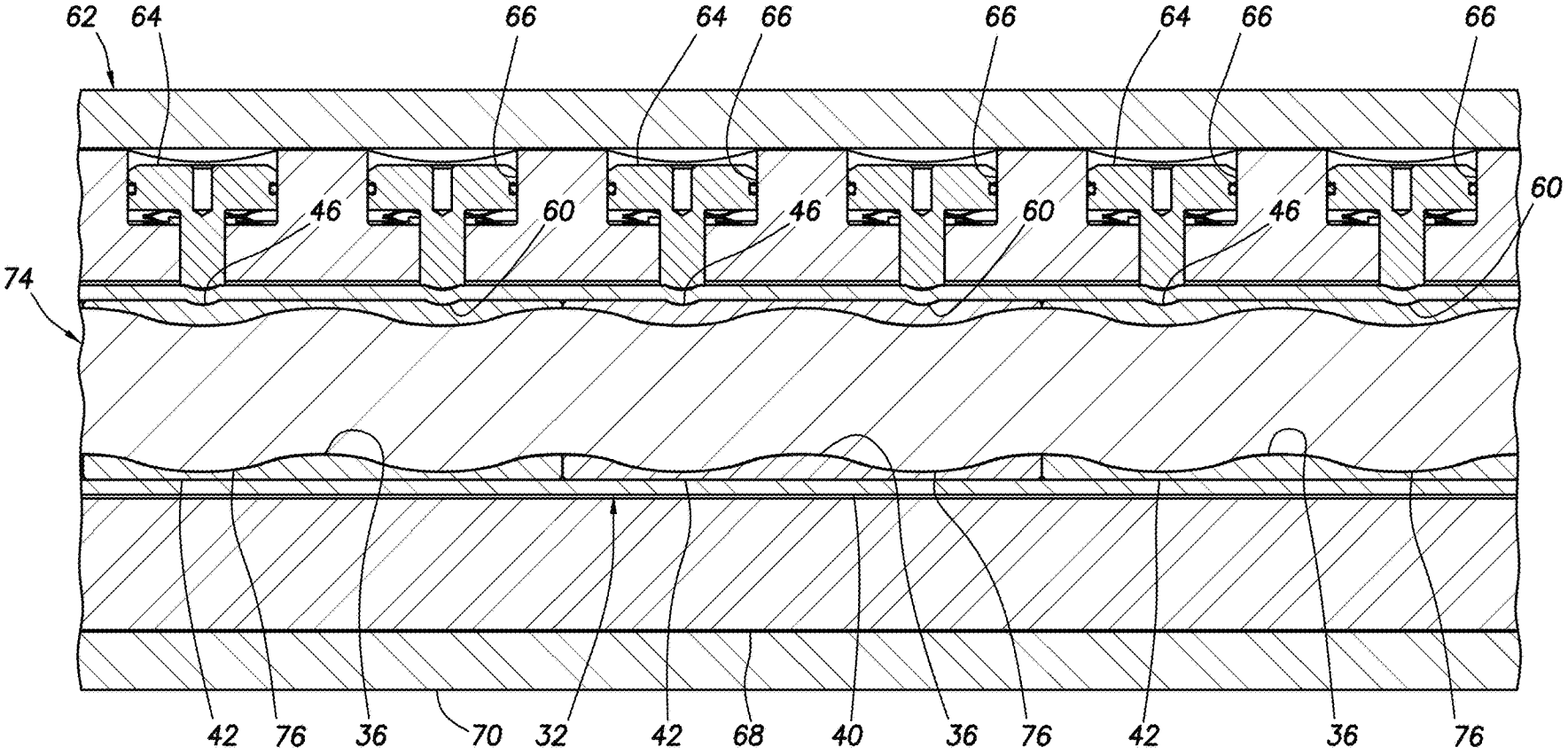
FIG. 9 is a representative cross-sectional view of another example of the stator in the housing deformation tool.

Referring additionally now to FIG. 9, a cross-sectional view of another example of the protrusions 60 being formed in the housing 40 of the stator 32 is representatively illustrated. In this example, an alignment mandrel 74 is used to rotationally index and align the stator sections 42 relative to each other.

The alignment mandrel 74 has external helical lobes 76 formed thereon. The lobes 74 are complementary to the lobes 36 of the stator sections 42. When the stator sections 42 are positioned end-to-end on the alignment mandrel 74, the stator sections are rotationally indexed and aligned with each other, so that the lobes 36 extend continuously through the stator sections.

The stator sections 42 may be positioned on the alignment mandrel 74 before or after the stator sections are installed in the housing 40. The stator sections 42 are positioned on the alignment mandrel 74 and installed in the housing 40 prior to deforming the protrusions 60 into the recesses 46, in the FIG. 9 example.

Figure 10:
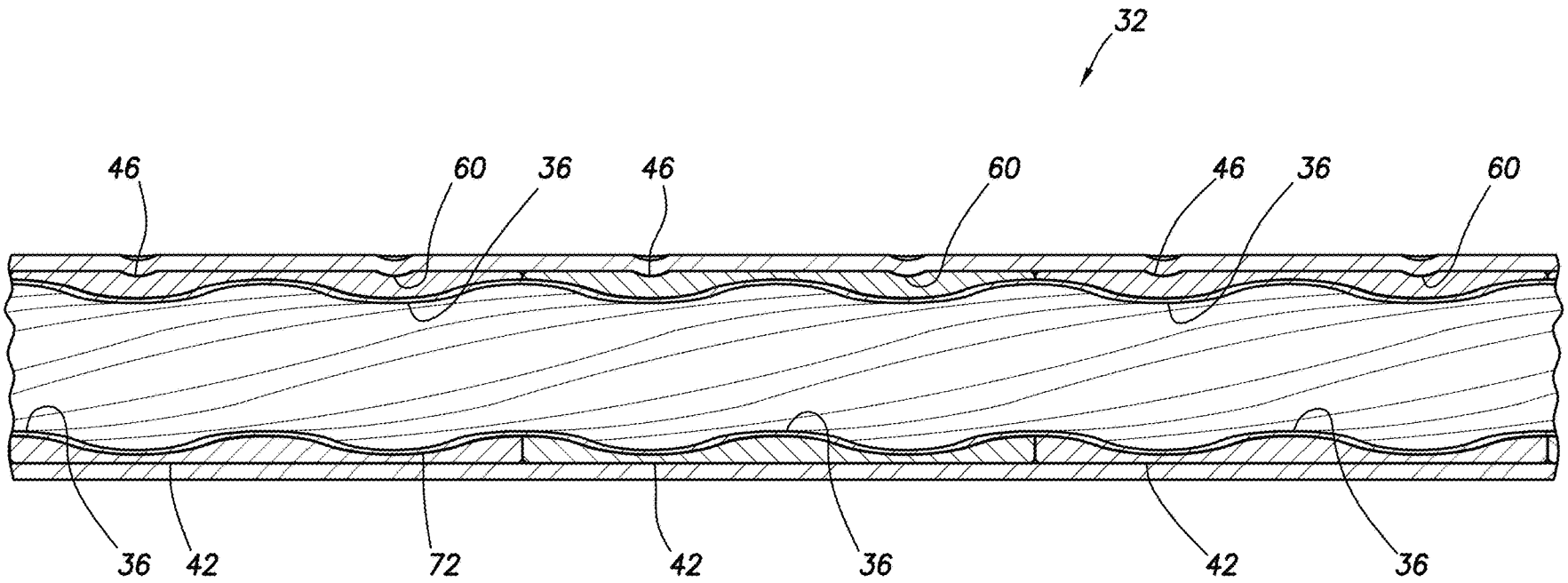
FIG. 10 is a representative cross-sectional view of another example of the stator.

Referring additionally now to FIG. 10, a cross-sectional view of another example of the stator 32 is representatively illustrated. In the FIG. 10 example, a coating or lining 72 is provided in the stator sections 42. The lining 72 is attached to the interior surfaces of the stator sections 42, so that the lining forms an interior layer of the lobes 36. The lining 72 can be selected to enhance sealing between the exterior and interior lobes 34, 36 of the rotor 30 and stator 32, to extend a useful life of the fluid motor 22, to reduce friction, to increase output or efficiency, or for any other beneficial purpose.

The lining 72 may comprise a suitable material selected to achieve one or more purpose or function. For example, the material could comprise an elastomer (such as, rubber, etc.), a relatively ductile but tough material (such as, a metal), a wear resistant material, a relatively low coefficient of friction material, etc. The scope of this disclosure is not limited to any particular material used for the lining 72.

The lining 72 may be installed or attached using any suitable technique. For example, the lining 72 may be molded, deposited, adhered, sprayed, bonded, accumulated or otherwise applied on the interior surfaces of the stator sections 42, preferably after the stator sections have been rotationally indexed and aligned with each other. The stator sections 42 may or may not be secured in the housing 40 when the lining 72 is applied on the interior surfaces of the stator sections.

Figure 11:
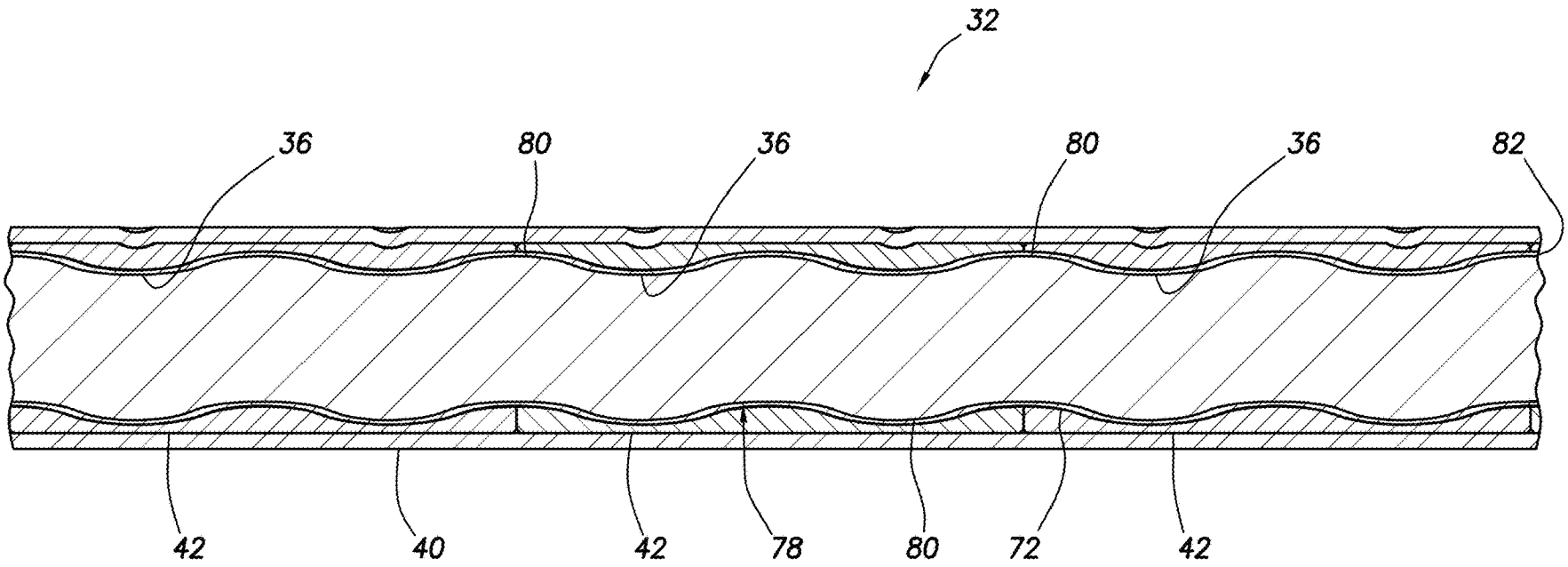
FIG. 11 is a representative cross-sectional view of another example of the stator with a lining being formed in the stator.

Referring additionally now to FIG. 11, a cross-sectional view of an example of the lining 72 being installed in the stator sections 42 is representatively illustrated. In this example, the lining 72 is formed by injecting a material 80 between the stator sections 42 and an externally profiled mandrel 78 installed in the stator sections.

The mandrel 78 may be similar in many respects to the FIG. 9 alignment mandrel 74. However, the mandrel 78 is dimensioned to provide a suitably thick gap between the mandrel and the stator sections 42, so that the material 82 can be injected into the gap. After the material 82 has cured, hardened, etc., the mandrel 78 can be removed from the stator sections 42.

As depicted in FIG. 11, the mandrel 78 has external helical lobes 80 formed thereon which are complementary to, but spaced apart somewhat from, the internal lobes 36 of the stator sections 42. The spacing or gap between the lobes 36, 80 may be consistent along the axial length of the stator 32, or there may be variations in the thickness of the material 82. The scope of this disclosure is not limited to any particular shape or configuration of the lining 72.

The mandrel 78 and lining 72 may serve to rotationally index and align the stator sections 42 relative to each other while the stator sections are being secured in the housing 40 (e.g., while the housing 40 is being deformed as depicted in FIGS. 8 & 9, or while a material 98 is being injected between the housing and the stator sections, etc.). Alternatively, the mandrel 78 and lining 72 may be installed after the stator sections 42 are secured in the housing 40. The scope of this disclosure is not limited to any particular order of steps (e.g., installing the stator sections 42 in the housing 40, securing the stator sections in the housing, rotationally indexing and aligning the stator sections, installing the mandrel 78, injecting the material 82, etc.).

Figure 12:
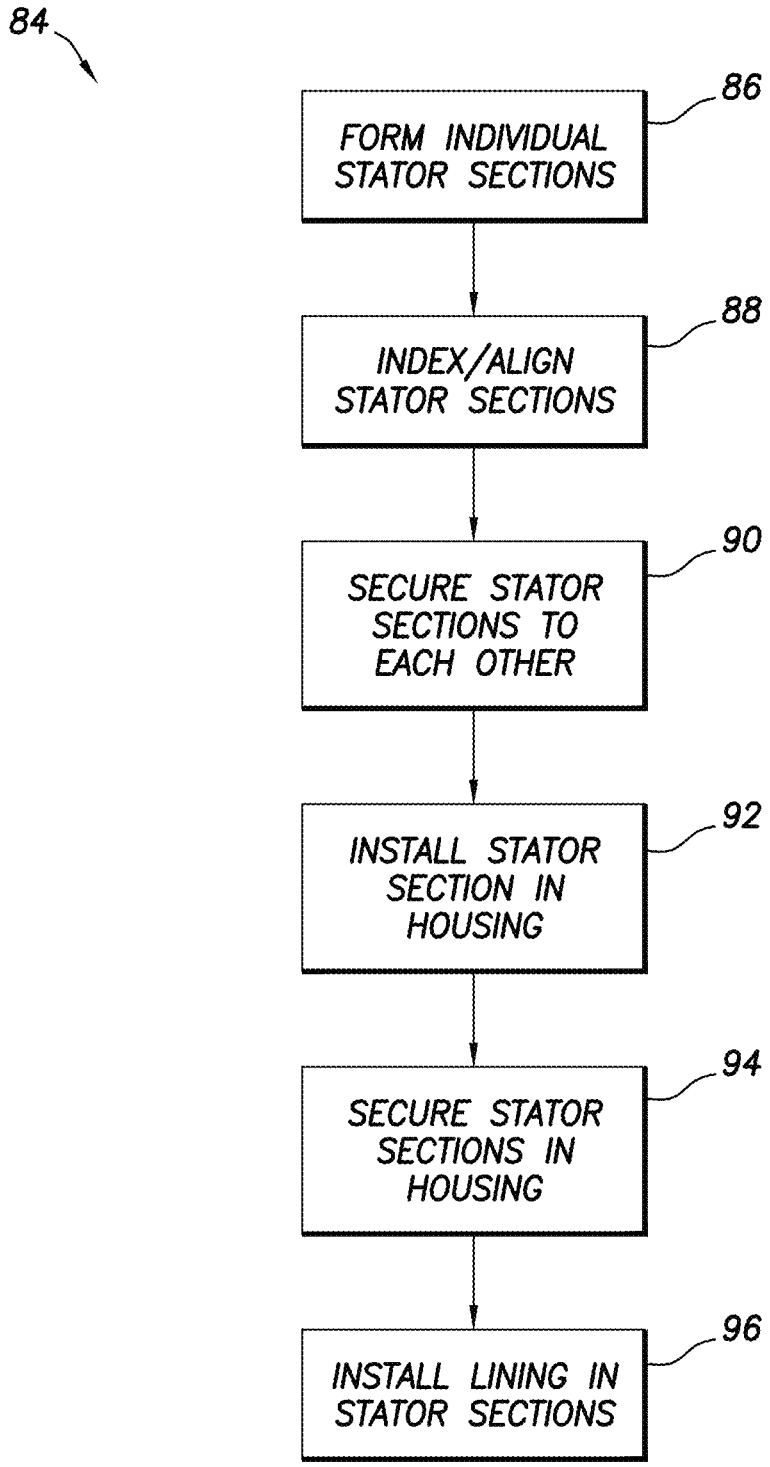
FIG. 12 is a representative flow chart for an example method of producing the stator.

Referring additionally now to FIG. 12, a flowchart for an example method 84 of producing the fluid motor 22 is representatively illustrated. However, the method 84 may be used to produce other fluid motors in keeping with the scope of this disclosure. Although a particular order of steps is depicted in FIG. 12, the scope of this disclosure is not limited to any particular order, number or combination of steps as depicted in FIG. 12 or described herein.

In an initial step 86 depicted in FIG. 12, multiple separate, individual stator sections 42 are formed. The stator sections 42 have internal helical lobes 36 formed therein. Any technique (such as, casting, molding, electrical discharge machining, three-dimensional printing, powder metallurgy, etc.) may be used for forming the stator sections 42 and the lobes 36 therein.

In step 88, the stator sections 42 are rotationally indexed and aligned with each other. Adjacent pairs of the stator sections 42 are rotationally indexed, so that the lobes 36 extend continuously from one stator section to the next.

Various techniques may be used for rotationally indexing and aligning the stator sections 42. Examples include (but are not limited to) positioning the stator sections 42 on the alignment mandrel 74, engaging devices 54, 56, 58 on ends 50, 52 of the stator sections, etc. In one example, helical grooves could be formed on exterior surfaces of the stator sections 42, and a helical member could be installed in the aligned grooves to maintain the rotational alignment of the stator sections.

In step 90, the stator sections 42 are secured to each other. Adjacent pairs of the stator sections 42 may be secured directly to each other (such as, by welding, bonding, etc.), or an additional component (such as, the housing 40) may be used to indirectly secure the stator sections relative to each other.

In step 92, the stator sections 42 are installed in the housing 40. In different examples, the stator sections 42 may be installed in the housing 40 before or after the stator sections are secured to each other.

In one example, a material 98 (such as, an elastomer, a bonding agent, an adhesive, etc.) is injected between the stator sections 42 and the housing 40 after the stator sections are installed in the housing. In another example, the housing 40 is deformed to secure the stator sections 42 in the housing, and to secure the stator sections relative to each other, after the stator sections are installed in the housing. In yet another example, welds are formed through openings in a wall of the housing 40 to thereby to secure the stator sections 42 in the housing, and to secure the stator sections relative to each other, after the stator sections are installed in the housing.

In step 94, the stator sections 42 are secured in the housing 40. In some examples, securing the stator sections 42 in the housing 40 also serves to secure the stator sections to each other.

In various examples described above, the stator sections 42 can be secured in the housing 40 by deforming the housing (such as, forming the protrusions 60 that extend into the recesses 46 on the stator sections), welding the stator sections to the housing (such as, via holes in the housing wall), or injecting a material 98 (such as, an elastomer, a bonding agent, an adhesive, etc.) between the housing and the stator sections. However, the scope of this disclosure is not limited to any particular technique used to secure the stator sections 42 to each other, or to the housing 40.

In step 96, a lining 72 can be provided in the stator sections 42, for example, if metal-to-metal contact is not desired between the rotor 30 and stator 32. The lining 72 may be installed in the stator sections 42 at various points in the method 84. Thus, it is not necessary for the lining 72 to be installed after the stator sections 42 are secured in the housing 40.

Various techniques may be used to install the lining 72 in the stator sections 42. For example, the lining 72 may be applied to the interior surfaces of the stator sections 42 by molding, spraying, depositing, three-dimensional printing, bonding, coating, etc. If molding is selected, an externally profiled mandrel 78 (e.g., having complementary external lobes 80) may be inserted into the stator sections 42, and then a material 82 injected into a gap between the mandrel 78 and the stator sections.

In some examples, the lining 72 could be produced separate from the stator sections 42. The lining 72 could initially be in the shape of a tube, for example. The lining 72 could be inserted into the stator sections 42 and bonded to the interior surfaces of the stator sections. Thus, the scope of this disclosure is not limited to any particular technique for installing the lining 72 in the stator sections 42.

It may now be fully appreciated that the above disclosure provides significant advancements to the art of designing, constructing and utilizing downhole fluid motors. In examples described above, the fluid motor 22 can include multiple stator sections 42 in the outer housing 40. The stator sections 42 may have a lining 72 therein, or metal-to-metal contact may be desired between the rotor 30 and the stator 32 in other examples.

The above disclosure provides to the art a downhole fluid motor 22 for use with a subterranean well. In one example, the downhole fluid motor 22 comprises a tubular housing 40 and a stator 32 comprising multiple stator sections 42. Each of the stator sections 42 has a helical stator profile (e.g., comprising lobes 36) formed therein. At least one deformation of the housing 40 secures each respective stator section 42 in the housing 40.

Each deformation of the housing 40 may extend into a recess 46 on the respective stator section 42.

The fluid motor 22 can include a lining 72 installed in the stator sections 42. The lining 72 may comprise an elastomeric material 82.

Relative rotation between adjacent ends 50, 52 of the stator sections 42 may be prevented.

The fluid motor 22 may include a rotor 30 configured to rotate in the stator 32 in response to fluid flow 24 between the rotor 30 and the stator 32. The rotor 30 may be configured to contact the stator sections 42 as the rotor 30 rotates in the stator 32. The rotor 30 may be configured to contact a lining 72 in the stator sections 42 as the rotor 30 rotates in the stator 32.

The stator sections 42 may be secured to each other without any weld. The stator sections 42 may be secured to the housing 40 without any weld.

Also provided to the art by the above disclosure is a method 84 of producing a downhole fluid motor 22 for use with a subterranean well. In one example, the method 84 can comprise: securing multiple stator sections 42 to each other, each of the stator sections 42 having a stator profile (e.g., lobes 36) formed therein; and securing the stator sections 42 in a tubular housing 40. The steps of securing the stator sections 42 to each other and securing the stator sections 42 in the housing 40 are performed without any welding.

The method 84 can include forming the stator sections 42 comprising a non-elastomeric material 48.

The method 84 can include, prior to the step of securing the stator sections 42 to each other, rotationally indexing the stator sections 42 relative to each other. The rotationally indexing step may include engaging index structures (e.g., the devices 54, 56, 58) on respective adjacent ends of the stator sections. The rotationally indexing step may include installing an alignment mandrel 74 in the stator sections 42.

The step of securing the stator sections 42 in the housing 40 may include deforming the housing 40 toward the stator sections 42, deforming the housing 40 into recesses 56 formed on each of the stator sections 42 and/or injecting a material 98 between the housing 40 and the stator sections 42.

The method 84 may include installing a lining 72 in the stator sections 42. The installing step may include injecting a material 82 between the stator sections 42 and an externally profiled mandrel 78 in the stator sections 42.

Another method 84 of producing a downhole fluid motor 22 for use with a subterranean well is described above. In this example, the method 84 can comprise: securing multiple stator sections 42 to each other, each of the stator sections 42 having a stator profile (e.g., the lobes 36) formed therein; and securing the stator sections 42 in a tubular housing 40. The step of securing the stator sections 42 in the housing 40 may include deforming the housing 40 toward the stator sections 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of producing a downhole fluid motor for use with a subterranean well, the method comprising:

securing multiple stator sections to each other, each of the stator sections having a stator profile formed therein; and securing the stator sections in a tubular housing, in which the securing the stator sections in the housing comprises deforming the housing into recesses formed on each of the stator sections, and in which the recesses are aligned with internal helical lobes formed in each of the stator sections, whereby the recesses are formed only in relatively thicker portions of the stator profile.

2. The method of claim 1, further comprising forming the stator sections comprising a non-elastomeric material.

3. The method of claim 1, in which the steps of securing the stator sections to each other and securing the stator sections in the housing are performed without any welding.

4. The method of claim 1, in which the securing the stator sections in the housing further comprises injecting a material between the housing and the stator sections.

5. The method of claim 1, further comprising installing a lining in the stator sections.

6. The method of claim 5, in which the installing comprises injecting a material between the stator sections and an externally profiled mandrel in the stator sections.

7. The method of claim 1, further comprising, prior to the securing the stator sections to each other, rotationally indexing the stator sections relative to each other.

8. The method of claim 7, in which the rotationally indexing comprises engaging index structures on respective adjacent ends of the stator sections.

9. The method of claim 7, in which the rotationally indexing comprises installing an alignment mandrel in the stator sections.

10. A method of producing a downhole fluid motor for use with a subterranean well, the method comprising:

providing a stator having a stator profile formed therein; and securing the stator in a tubular housing, in which the securing the stator in the housing comprises deforming the housing into at least one recess formed on the stator, in which the recess is aligned with an internal helical lobe formed in the stator, whereby the recess is formed only in a relatively thicker portion of the stator profile.

11. The method of claim 10, further comprising forming the stator comprising a non-elastomeric material.

12. The method of claim 10, in which the stator comprises multiple stator sections, further comprising securing the stator sections to each other, and in which the steps of securing the stator sections to each other and securing the stator in the housing are performed without any welding.

13. The method of claim 10, in which the securing the stator in the housing further comprises injecting a material between the housing and the stator.

14. The method of claim 10, further comprising installing a lining in the stator.

15. The method of claim 14, in which the installing comprises injecting a material between the stator and an externally profiled mandrel in the stator.

16. The method of claim 10, in which the stator comprises multiple stator sections, and further comprising rotationally indexing the stator sections relative to each other.

17. The method of claim 16, in which the rotationally indexing comprises engaging index structures on respective adjacent ends of the stator sections.

18. The method of claim 16, in which the rotationally indexing comprises installing an alignment mandrel in the stator sections.

* * * * *